US009379489B2

(12) United States Patent
Ebisawa

(10) Patent No.: US 9,379,489 B2
(45) Date of Patent: Jun. 28, 2016

(54) CONTACT, CONNECTOR, AND CONNECTING DEVICE

(71) Applicant: Japan Aviation Electronics Industry, Limited, Tokyo (JP)

(72) Inventor: Takeshi Ebisawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 30 days.

(21) Appl. No.: 14/400,394

(22) PCT Filed: Jun. 3, 2013

(86) PCT No.: PCT/JP2013/065372
§ 371 (c)(1),
(2) Date: Nov. 11, 2014

(87) PCT Pub. No.: WO2014/010331
PCT Pub. Date: Jan. 16, 2014

(65) Prior Publication Data

US 2015/0133003 A1 May 14, 2015

(30) Foreign Application Priority Data

Jul. 13, 2012 (JP) ..... 2012-157719

(51) Int. Cl.
*H01R 4/48* (2006.01)
*H01R 13/639* (2006.01)
*H01R 13/187* (2006.01)
(Continued)

(52) U.S. Cl.
CPC ..... *H01R 13/639* (2013.01); *H01R 4/4863* (2013.01); *H01R 11/24* (2013.01); *H01R 13/15* (2013.01); *H01R 13/187* (2013.01)

(58) Field of Classification Search
CPC .... H01R 13/639; H01R 13/187; H01R 13/15; H01R 11/24; H01R 4/4863
USPC ..... 439/249, 251, 817, 819
See application file for complete search history.

(56) References Cited

U.S. PATENT DOCUMENTS 2,793,355 A 5/1957 Randall et al.
2,872,659 A 2/1959 Wills
(Continued)

FOREIGN PATENT DOCUMENTS

CN 101026274 A 8/2007
CN 101064389 A 10/2007
(Continued)

OTHER PUBLICATIONS

Supplementary European Search Report in EP 13 74 6942, dated Oct. 20, 2015.
(Continued)

*Primary Examiner* — Khiem Nguyen
(74) *Attorney, Agent, or Firm* — Collard & Roe, P.C.

(57) ABSTRACT

A contact includes a pair of conductive members and a biasing member attached between the pair of conductive members and biasing the pair of conductive members toward each other. The pair of conductive members each have a base portion, an attaching portion, and a support portion. At least one of the pair of conductive members integrally has, at a position facing the other conductive member side, an inelastic contact-side engaging portion for engagement with a connection object-side engaging portion formed in a connection object.

10 Claims, 15 Drawing Sheets

(51) Int. Cl.
*H01R 11/24* (2006.01)
*H01R 13/15* (2006.01)

(56) References Cited

U.S. PATENT DOCUMENTS

| | | | |
|---|---|---|---|
| 3,171,709 | A | 3/1965 | Groody |
| 3,427,419 | A | 2/1969 | Findley, Jr. |
| 3,566,335 | A | 2/1971 | Powell |
| 3,723,940 | A | 3/1973 | Leonard |
| 3,845,523 | A | 11/1974 | Mayberry |
| 4,121,067 | A | 10/1978 | Rexroad et al. |
| 4,445,732 | A | 5/1984 | Wafer |
| 4,555,604 | A | 11/1985 | Maier et al. |
| 4,621,303 | A | 11/1986 | Rowe |
| 4,686,334 | A | 8/1987 | Nebon et al. |
| 5,041,028 | A | 8/1991 | Stahle |
| 5,098,318 | A | 3/1992 | Suter |
| 5,167,529 | A | 12/1992 | Verge |
| 5,928,022 | A | 7/1999 | Moeller |
| 8,672,717 | B2 | 3/2014 | Li et al. |
| 2002/0081883 | A1 | 6/2002 | Hotea et al. |
| 2006/0035492 | A1 | 2/2006 | Sekido |
| 2007/0197104 | A1 | 8/2007 | Nagawatari |
| 2007/0254534 | A1 | 11/2007 | Okamura et al. |
| 2009/0163086 | A1 | 6/2009 | Janulis et al. |
| 2014/0051308 | A1 | 2/2014 | Ebisawa et al. |

FOREIGN PATENT DOCUMENTS

| | | | |
|---|---|---|---|
| CN | 201918517 | U | 8/2011 |
| EP | 0 208 565 | A1 | 1/1987 |
| EP | 2 110 826 | A1 | 10/2009 |
| GB | 2268843 | A | 1/1994 |
| JP | S52-44369 | U | 3/1977 |
| JP | 62-131333 | U | 8/1987 |
| JP | 63-152173 | U | 10/1988 |
| JP | 02-123714 | A | 5/1990 |
| JP | H09102345 | A | 4/1997 |
| JP | 10-294140 | A | 11/1998 |
| JP | 2003208946 | A | 7/2003 |
| JP | 2003-346956 | A | 12/2003 |
| JP | 2006054154 | A | 2/2006 |
| JP | 4938148 | B1 | 4/2007 |
| JP | 2009-218063 | A | 9/2009 |
| JP | 2010-010024 | A | 1/2010 |
| WO | 2009-085445 | A2 | 7/2009 |

OTHER PUBLICATIONS

International Search Report of PCT/JP2013/065372, mailed Sep. 3, 2013.

Search Report of Chinese Office Action dated Sep. 15, 2015 in CN 201380004324.6 with English Translation of relevant part of Search Report.

Chinese Office Action in CN 201380028920.8 dated Mar. 3, 2016, with English translation of relevant parts.

Extended European Search Report in EP 13817212.7-1801, dated Apr. 12, 2016.

CONTACT, CONNECTOR, AND CONNECTING DEVICE

CROSS REFERENCE TO RELATED APPLICATIONS

This application is the National Stage of PCT/JP2013/065372 filed on Jun. 3, 2013, which claims priority under 35 U.S.C. §119 of Japanese Application No. 2012-157719 filed on Jul. 13, 2012, the disclosure of which is incorporated by reference. The international application under PCT article 21 (2) was not published in English.

TECHNICAL FIELD

This invention relates to a contact, a connector, and a connecting device.

BACKGROUND ART

Conventionally, as shown in FIG. 12, there is known a contact 110 comprising a pair of conductive members 120 and a biasing member 130 attached between the pair of conductive members 120 and biasing the pair of conductive members 120 toward each other, wherein each conductive member 120 has a base portion 121 and an attaching portion 122 formed at the base portion 121 and attached with the biasing member 130, wherein the base portion 121 of one of the conductive members 120 and the base portion 121 of the other conductive member 120 are disposed to be spaced apart from each other, and wherein at least one of the pair of conductive members 120 has a support portion 123 extending from the base portion 121 toward the other conductive member 120 to contact and support the other conductive member 120 (see Patent Document 1).

The contact 110 of FIG. 12 is adapted to be connected to a connection object (not illustrated) inserted from the outside by holding the connection object (not illustrated) between the pair of conductive members 120. However, if an external force is applied to the connection object in a pull-out direction in the state where the connection object is inserted into the contact 110, the connection object tends to come out of the contact 110.

On the other hand, as shown in FIGS. 13A and 13B, there is known a locking structure in which a relay terminal 210 adapted to be connected to a connection object 240 is provided with an elastically deformable claw piece 226 adapted to engage with the connection object 240, thereby preventing coming-off of the connection object 240 (see, e.g. Patent Document 2).

In the locking structure of FIGS. 13A and 13B, when attaching the connection object 240 to the relay terminal 210, first, the claw piece 226 is pushed by the connection object 240 inserted into the relay terminal 210 so as to be elastically deformed. Then, when a rectangular hole 241 formed in the connection object 240 reaches the position of the claw piece 226, the claw piece 226 enters the rectangular hole 241 so that the claw piece 226 is elastically restored. As a result, the rectangular hole 241 and the claw piece 226 engage with each other, thereby preventing coming-off of the connection object 240 from the relay terminal 210.

PRIOR ART DOCUMENT

Patent Document

Patent Document 1: Japanese Patent (JP-B) No. 4938148
Patent Document 2: JP-A-H9-102345

SUMMARY OF THE INVENTION

Problem to be Solved by the Invention

However, in the locking structure of FIG. 13, the claw piece 226 itself that engages with the connection object 240 should have elasticity and thus it is difficult to sufficiently ensure the strength of the claw piece 226. Consequently, if an external force is applied to the connection object 240 in a pull-out direction, the claw piece 226 tends to be deformed so that the connection object 240 tends to come out of the relay terminal 210, and further, the claw piece 226 tends to be damaged.

When detaching the connection object 240 from the relay terminal 210 for the purpose of replacement, repair, or the like, it is necessary to partially operate only the claw piece 226 using a jig or the like, thereby releasing the engagement between the rectangular hole 241 of the connection object 240 and the claw piece 226 of the relay terminal 210. However, when the relay terminal 210 is small in size, the operation of the claw piece 226, itself, is difficult to achieve and, further, if force adjustment fails, the claw piece 226 may be damaged.

It is therefore an object of this invention to provide a contact, a connector, and a connecting device, which, while avoiding an increase in the number of components, can surely prevent coming-off of a connection object and further can allow the connection object to be easily detached without being damaged.

Means for Solving the Problem

A contact according to an aspect of the present invention comprises a pair of conductive members and a biasing member attached between the pair of conductive members and biasing the pair of conductive members toward each other, the contact adapted to be connected to a connection object, inserted between the pair of conductive members, by holding the connection object between the pair of conductive members, wherein the pair of conductive members each have a base portion and an attaching portion formed at the base portion and attached with the biasing member, wherein the base portion of one of the conductive members and the base portion of the other of the conductive members are arranged to be spaced apart from each other, wherein at least one of the pair of conductive members has a support portion extending from the base portion side toward the other of the conductive members to contact and support the other of the conductive members, and wherein at least one of the pair of conductive members integrally has, at a position facing the side of the other of the conductive members, an inelastic contact-side engaging portion for engagement with a connection object-side engaging portion formed in the connection object.

A connector according to an aspect of the present invention comprises the contact.

A connecting device according to an aspect of the present invention comprises the contact and the connection object having the connection object-side engaging portion.

Effect of the Invention

According to this invention, it is possible to provide a contact, a connector, and a connecting device, which, while avoiding an increase in the number of components, can surely prevent coming-off of a connection object and further can allow the connection object to be easily detached without being damaged.

MODE FOR CARRYING OUT THE INVENTION

Figure 1:
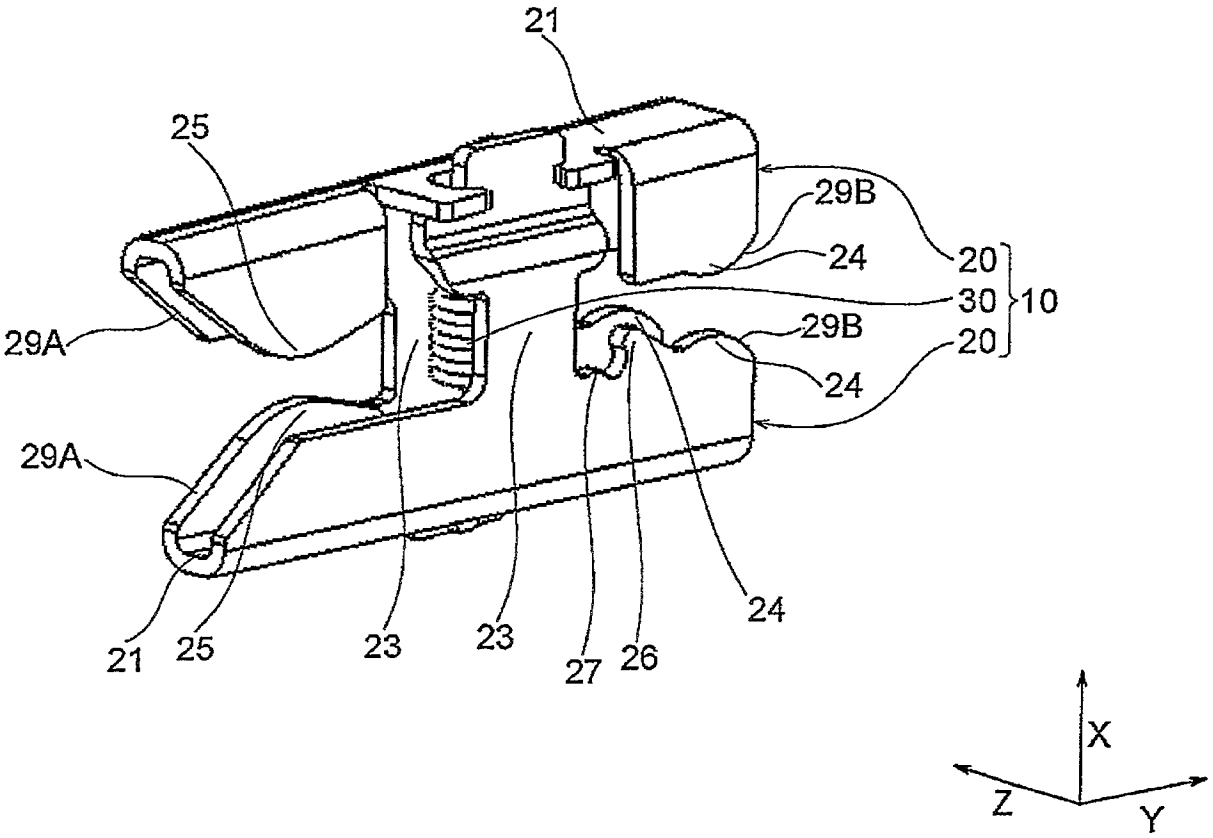
FIG. 1 is a perspective view showing a contact according to an embodiment of this invention.

Referring to the drawings, a contact according to an embodiment of this invention will be described. In the figures, a first direction X, a second direction Y, and a third direction Z represent directions which are perpendicular to each other.

Figure 2:
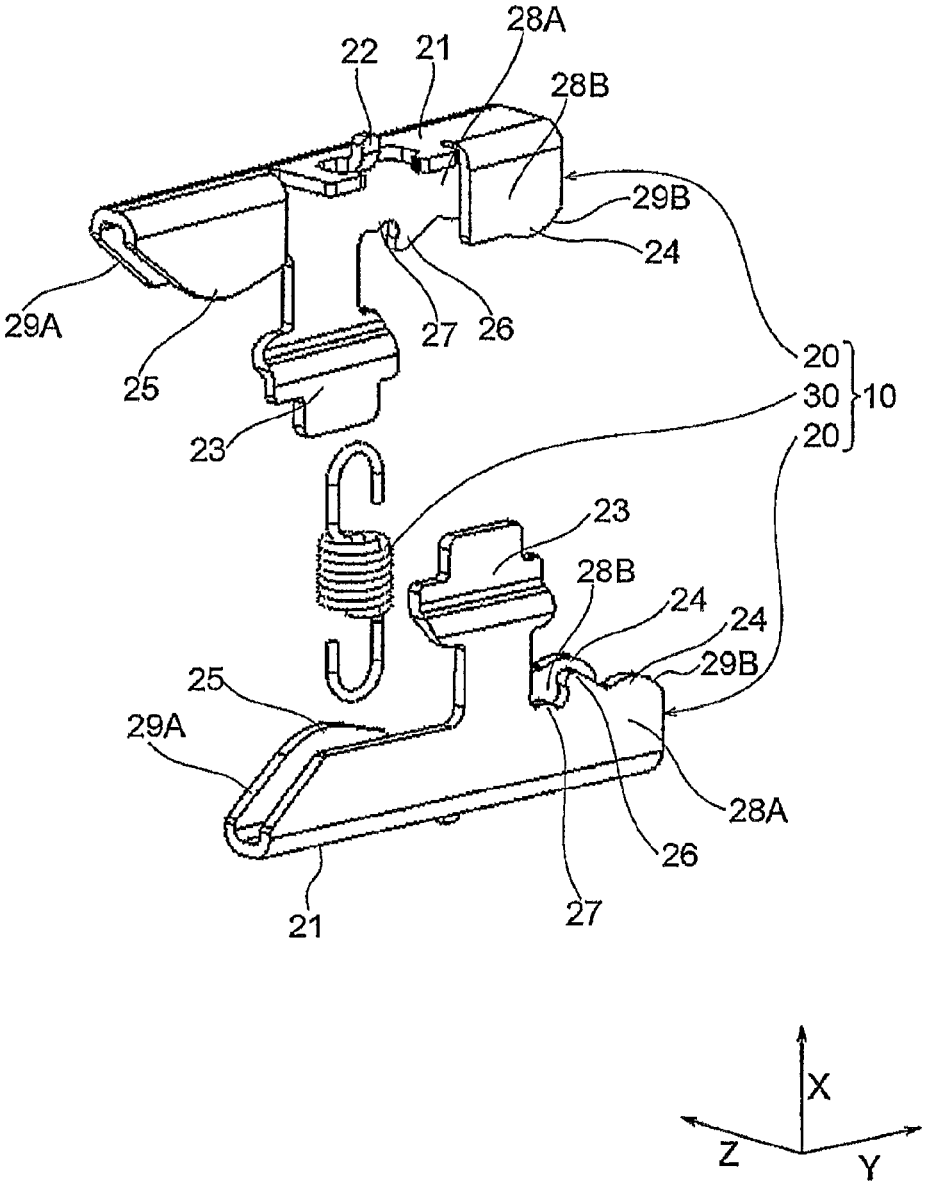
FIG. 2 is an exploded perspective view of the contact of FIG. 1.

In FIGS. 1 and 2, the contact is denoted by a reference symbol 10 and comprises a pair of conductive members 20 and a biasing member 30 in the form of a coil spring which is attached between the pair of conductive members 20 and biases the pair of conductive members 20 toward each other (i.e. applies a force between the pair of conductive members 20 by an elastic force of the coil spring or the like). The contact 10 is configured such that the three-dimensional structure is autonomously maintained in its assembled state.

Figure 3A:
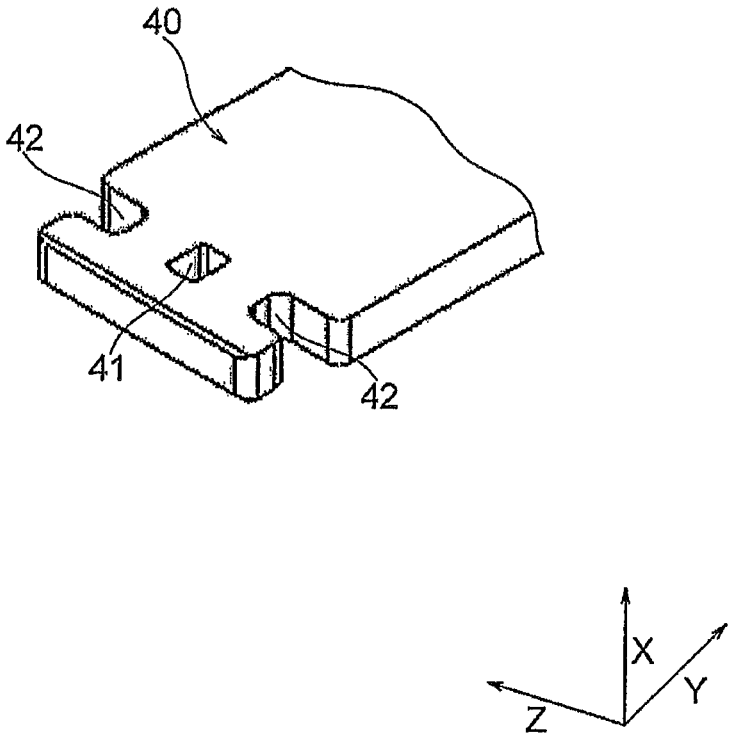
FIG. 3A is a perspective view of only a main part showing a first bus bar to which the contact of FIG. 1 can be connected.
Figure 3B:
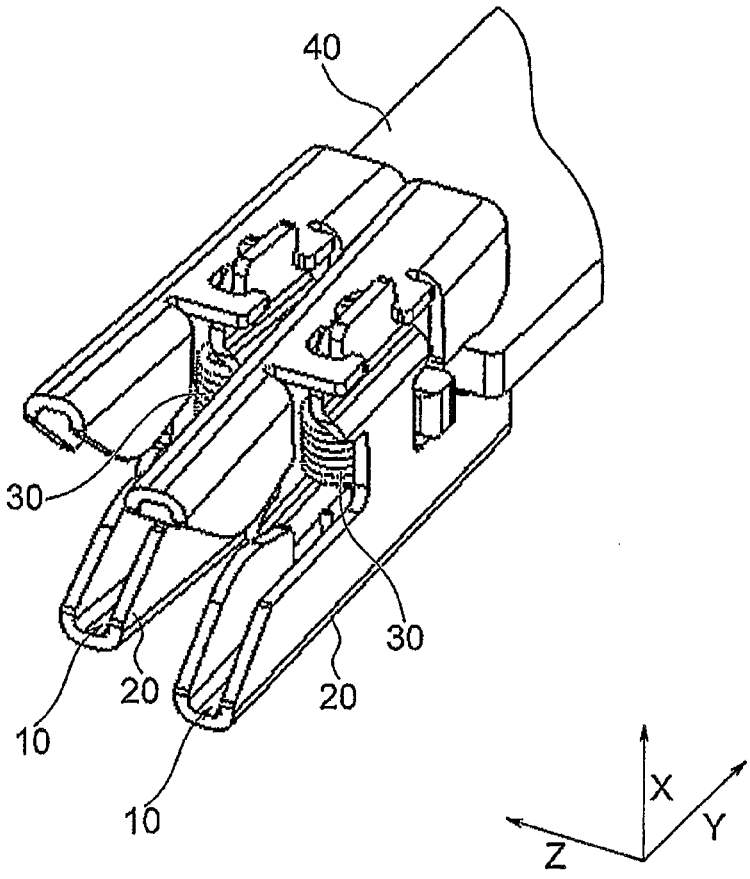
FIG. 3B is a perspective view of only a main part showing a state where two contacts, each of FIG. 1, are connected to the first bus bar of FIG. 3A.
Figure 4A:
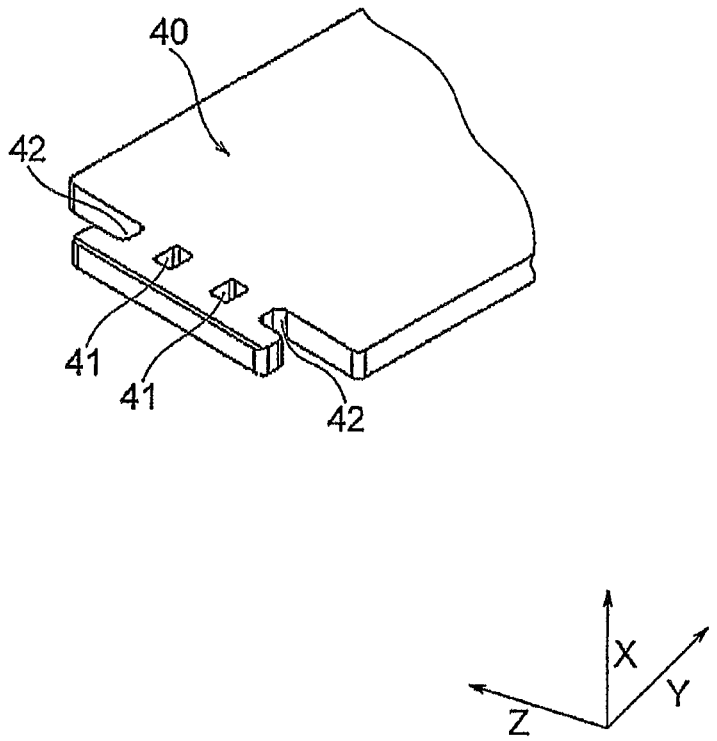
FIG. 4A is a perspective view of only a main part showing a modification of the first bus bar of FIG. 3A.
Figure 4B:
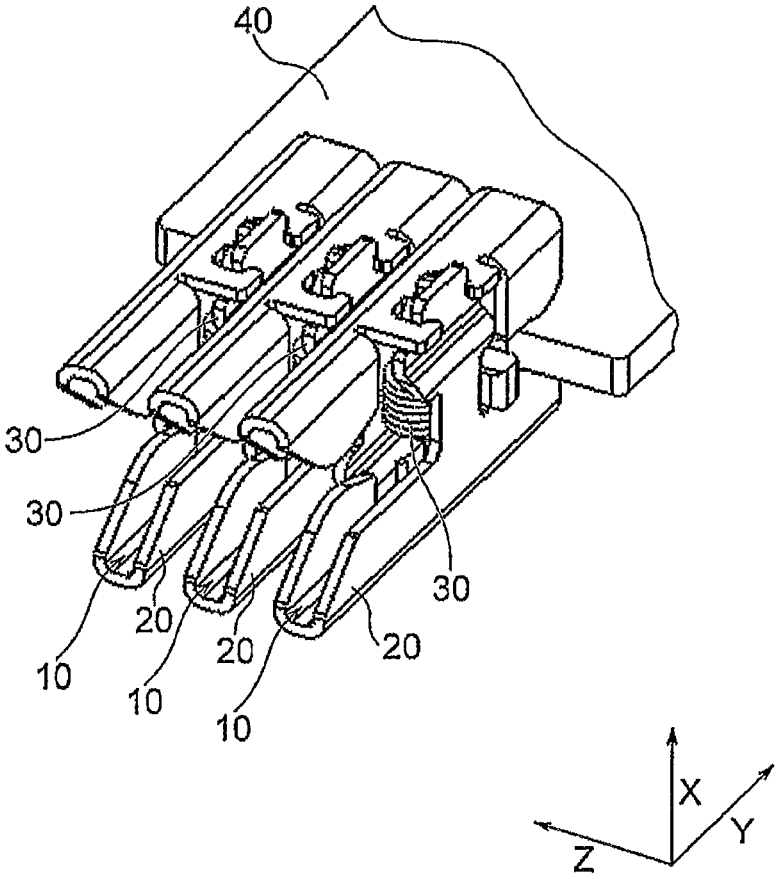
FIG. 4B is a perspective view of only a main part showing a state where three contacts, each of FIG. 1, are connected to the first bus bar of FIG. 4A.

As shown in FIG. 3B or FIG. 4B, a plurality of contacts 10 are attached to a single first bus bar 40 and to a single second bus bar 50. Herein, FIG. 3B shows a state where two contacts 10 are arranged side by side in the third direction Z and attached to a single first bus bar 40, while FIG. 4B shows a state where three contacts 10 are arranged side by side in the third direction Z and attached to a single first bus bar 40. The number of contacts 10 for use with a single first bus bar 40 and with a single second bus bar 50 is not limited and one or two or more may be appropriately selected according to the magnitude of current to be supplied, the calorific value, and so on.

Referring back to FIGS. 1 and 2, the conductive members 20 will be described.

The pair of conductive members 20 have the same shape as each other. Each conductive member 20 is formed by punching an inelastic conductive metal plate into a predetermined shape and then bending predetermined portions thereof. As will be described in order hereinbelow, each conductive member 20 integrally has a base portion 21 arranged facing and spaced apart from that of the other conductive member 20, an attaching portion 22 attached with the biasing member 30, a support portion 23 extending toward the other conductive member 20 to support the other conductive member 20, first contact portions 24 for contact with the first bus bar 40, a second contact portion 25 for contact with the second bus bar 50, an inelastic contact-side engaging portion 26 for engagement with a bus bar-side engaging portion 41 or 42, and an inclination control portion 27 for limiting relative inclination between the first bus bar 40 and the contact 10.

Each conductive member 20 is formed with the two first contact portions 24. Specifically, each conductive member 20 has a first plate portion 28A and a second plate portion 28B each extending from the base portion 21 toward the other conductive member 20 and the first contact portions 24 are respectively formed at upper end portions of the first plate portion 28A and the second plate portion 28B. The number of the first contact portions 24 which should be formed in each conductive member 20 is not limited to two described above.

The two first contact portions 24 formed in each conductive member 20 are arranged to be spaced apart from each other in the third direction Z. The two first contact portions 24 formed in each conductive member 20 are arranged to respectively face the first contact portions 24 of the other conductive member 20 in the first direction X.

The distance between the first contact portions 24 facing each other in the first direction X is set greater than the thickness of the first bus bar 40 in the state where neither of the first bus bar 40 and the second bus bar 50 is inserted into the contact 10.

The second contact portion 25 is formed on the side opposite to the first contact portions 24 with respect to the attaching portion 22 interposed therebetween. Each conductive member 20 is formed with the single second contact portion 25. In the assembled state of the contact 10, the second contact portions 25 are arranged to be offset from each other in the third direction Z and to face each other in the first direction X.

The distance between the second contact portions 25 facing each other in the first direction X is set smaller than the thickness of the second bus bar 50 in the state where neither of the first bus bar 40 and the second bus bar 50 is inserted into the contact 10.

The contact-side engaging portion 26 is protrusively formed at a position facing the other conductive member 20, specifically, at an upper end portion of the first plate portion 28A. When the contact 10 and the first bus bar 40 are connected to each other, the contact-side engaging portions 26 are received in the bus bar-side engaging portions 41 and 42 so as to serve also to restrict movement of the contact 10 in the third direction Z relative to the first bus bar 40. The contact-side engaging portion 26 is formed at a position closer to the attaching portion 22 side than the first contact portion 24.

Figure 5:
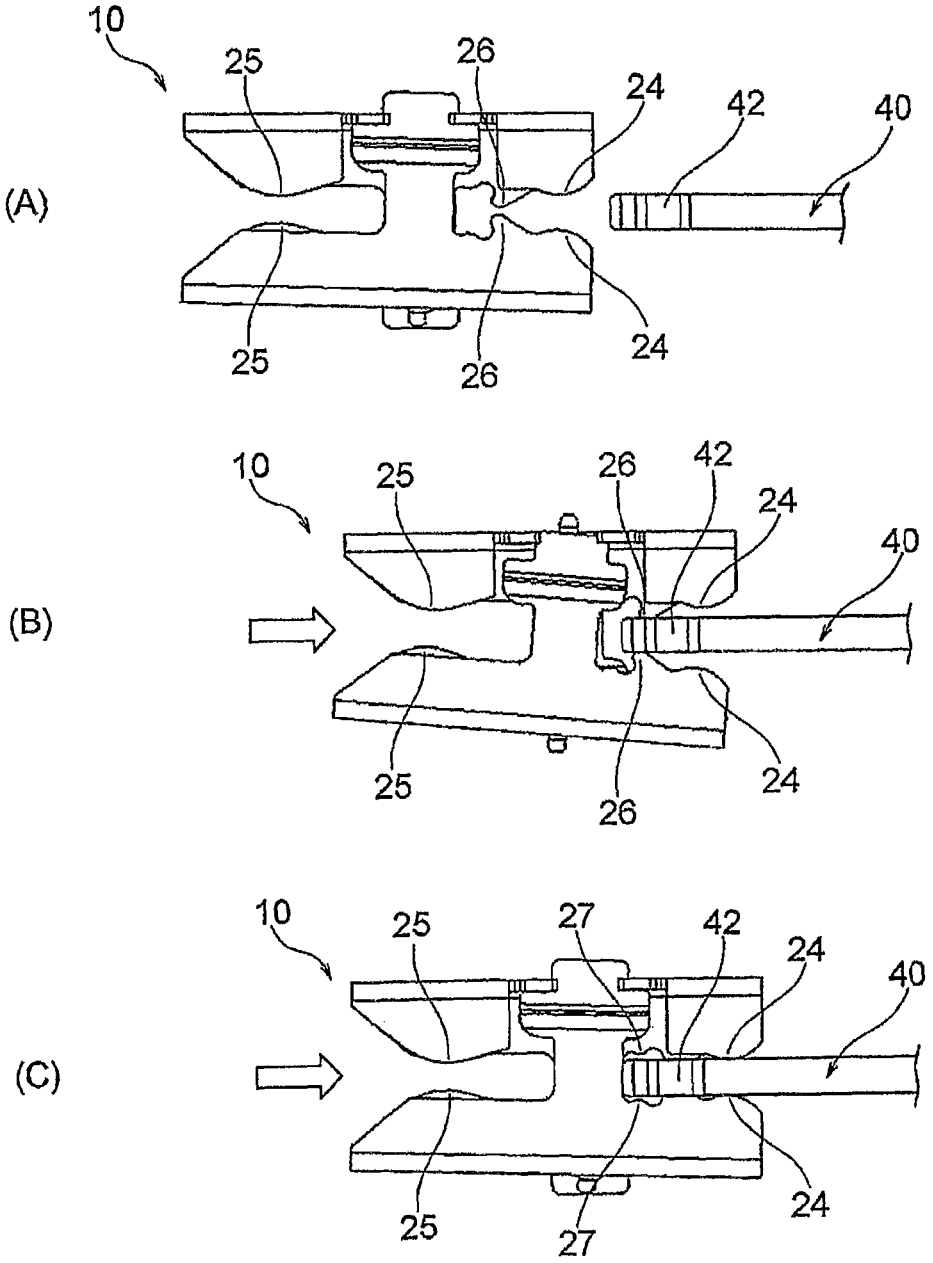
FIG. 5 is an explanatory diagram for explaining the sequence of attaching the contact to the first bus bar.

Each conductive member 20 has the single contact-side engaging portion 26. As shown in FIG. 5, in the assembled state of the contact 10, the contact-side engaging portion 26 of one of the conductive members 20 and the contact-side engaging portion 26 of the other conductive member 20 are located at the same position in the second direction Y. On the other hand, in the assembled state of the contact 10, the contact-side engaging portion 26 of one of the conductive members 20 and the contact-side engaging portion 26 of the other conductive member 20 are arranged to be offset from each other in the third direction Z.

The inclination control portion 27 is a portion for limiting relative inclination between the first bus bar 40 and the contact 10 and, as shown in FIGS. 1 and 2, is protrusively formed at a position facing the other conductive member 20, specifically, at an upper end portion of the first plate portion 28A. The inclination control portion 27 is formed adjacent to the contact-side engaging portion 26 at a position closer to the attaching portion 22 side than the contact-side engaging portion 26. Each conductive member 20 has the single inclination control portion 27. In the assembled state of the contact 10, the inclination control portion 27 of one of the conductive members 20 and the inclination control portion 27 of the other conductive member 20 are located at the same position in the second direction Y.

As shown in FIG. 3A or FIG. 4A, the first bus bar 40 has, near its end, a hole-like bus bar-side engaging portion or portions 41 formed in the middle in the third direction Z and cutout-like bus bar-side engaging portions 42 formed on both sides in the third direction Z. Specifically, in the case where the two contacts 10 are attached to the first bus bar 40 as shown in FIG. 3B, the first bus bar 40 is formed with the single hole-like bus bar-side engaging portion 41, while, in the case where the three contacts 10 are attached to the first bus bar 40 as shown in FIG. 4B, the first bus bar 40 is formed with the two hole-like bus bar-side engaging portions 41. When the contacts 10 and the first bus bar 40 are connected to each other, the two contact-side engaging portions 26 are received in the or each hole-like bus bar-side engaging portion 41, while the single contact-side engaging portion 26 is received in each cutout-like bus bar-side engaging portion 42.

Next, referring to FIGS. 5 to 8, the sequence of attaching the contact 10 to the first bus bar 40 and the operations of the respective portions during the attachment will be described.

First, when attaching the contact 10 to the first bus bar 40, the contact 10 is caused to approach the first bus bar 40 with the first contact portion 24 side at the head as shown at (A) in FIG. 5. Thereupon, the first bus bar 40 abuts against the contact-side engaging portions 26 so that the pair of conductive members 20 are pushed by the first bus bar 40 to move in directions in which the pair of contact-side engaging portions 26 move away from each other.

Then, as shown at (B) in FIG. 5, the first bus bar 40 rides over the contact-side engaging portions 26 so that the contact-side engaging portions 26 reach the positions of the bus bar-side engaging portions 41 and 42. Thereupon, as shown at (C) in FIG. 5, the contact-side engaging portions 26 are received in the bus bar-side engaging portions 41 and 42 so that the attachment of the contact 10 to the first bus bar 40 is completed. As shown in FIGS. 1 and 2, a guide portion 29B for guiding the first bus bar 40 is formed at a front end portion, on the first contact portion 24 side, of each conductive member 20.

Figure 6:
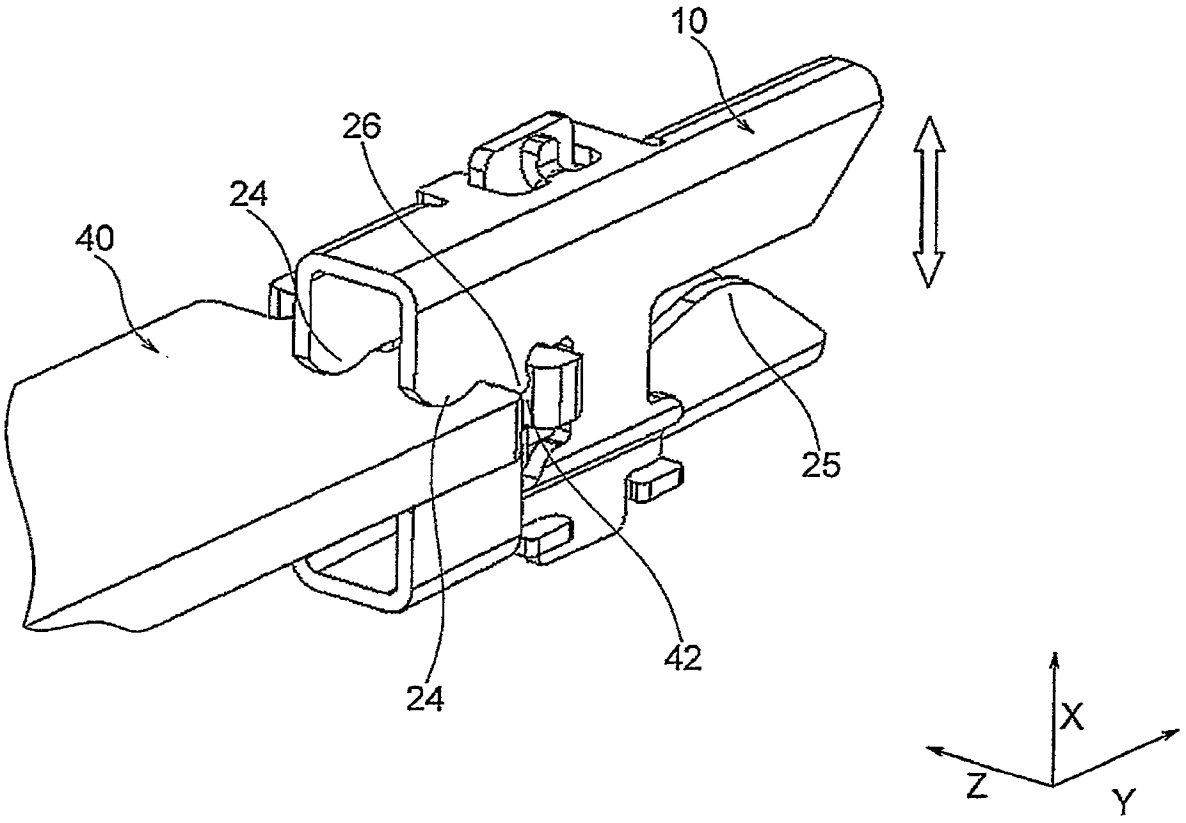
FIG. 6 is a perspective view of only a main part showing a state where one of the contacts is attached to the first bus bar.
Figure 7A:
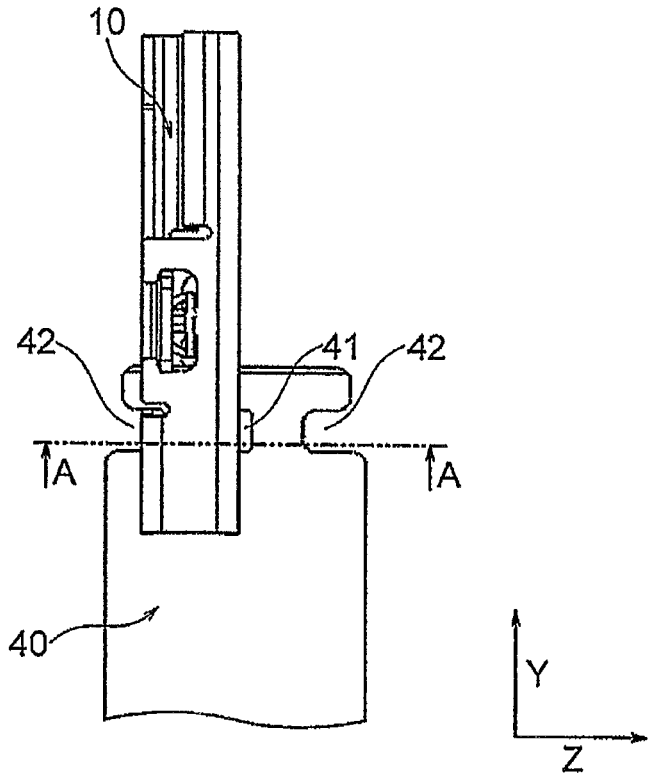
FIG. 7A is a top view of FIG. 6.
Figure 7B:
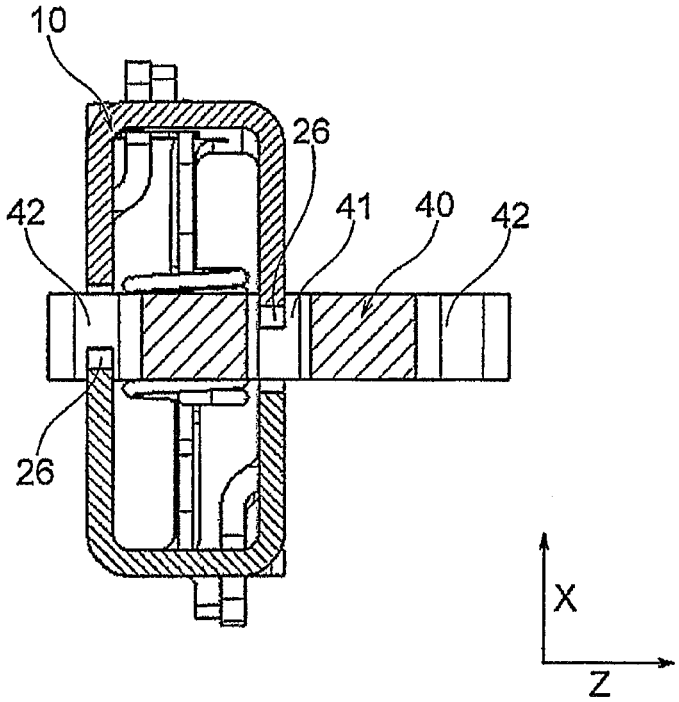
FIG. 7B is a cross-sectional view taken along line A-A of FIG. 7A.
Figure 8:
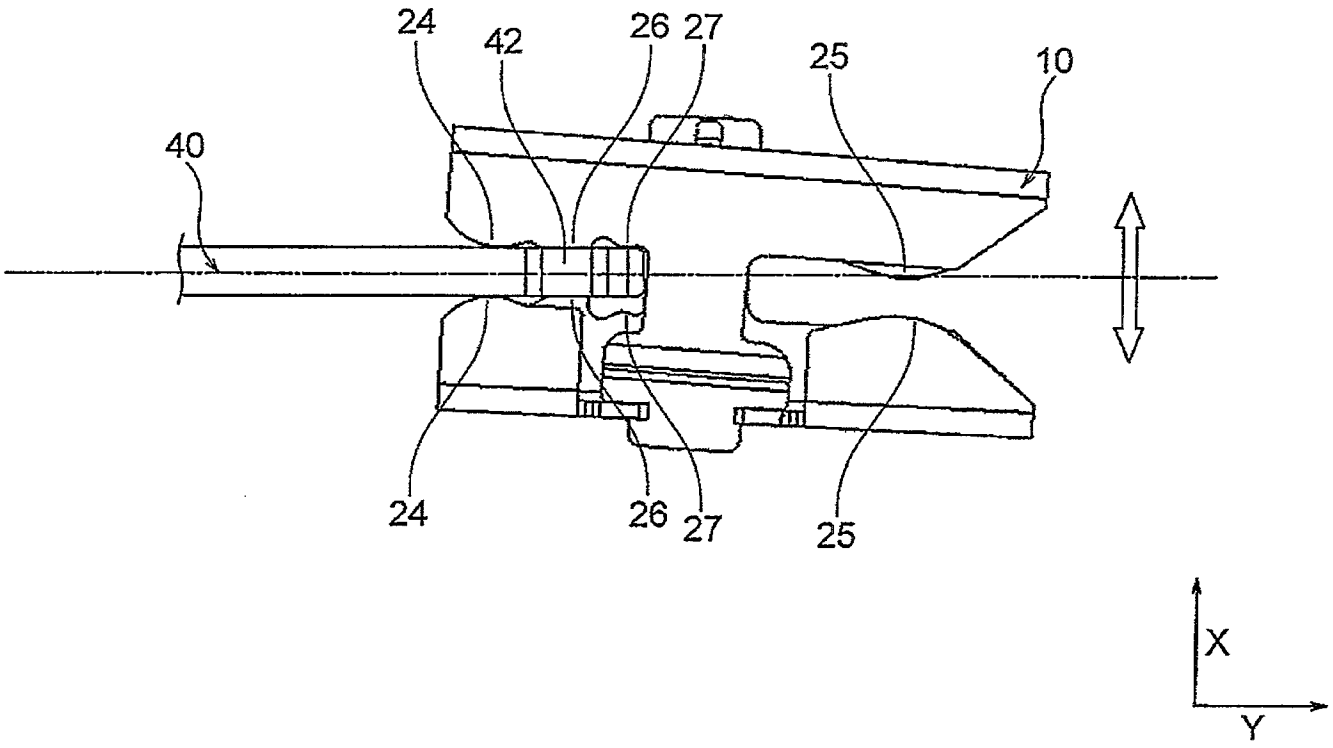
FIG. 8 is an explanatory diagram for explaining a state of floating of the second contact portion side of the contact in the state where the contact is attached to the first bus bar.

In the state where the attachment of the contact 10 to the first bus bar 40 is completed as shown in FIGS. 6 to 8, there is a certain play (clearance) between the contact-side engaging portions 26 and the bus bar-side engaging portions 41 and 42. Consequently, the second contact portion 25 side of the contact 10 can float (move) in the first direction X.

Since the distance between the first contact portions 24 facing each other in the first direction X is set greater than the thickness of the first bus bar 40, a clearance is formed between at least one of the first contact portions 24 facing each other in the first direction X and a front surface or a back surface of the first bus bar 40. Therefore, even if the second contact portion 25 side of the contact 10 floats in the first direction X, since the interference between the first contact portions 24 and the first bus bar 40 is small, the relative movement between the contact 10 and the first bus bar 40 is smooth and, since the first contact portions 24 and the first bus bar 40 are not excessively rubbed with each other, it is possible to maintain a good surface state of the first contact portions 24 and the first bus bar 40 and thus to avoid a reduction in contact reliability.

In particular, as shown in FIG. 6, since each conductive member 20 has the two first contact portions 24 and the two first contact portions 24 formed in each conductive member 20 are arranged to be spaced apart from each other in the third direction Z, the inclination (rotation) of the contact 10 relative to the first bus bar 40 in a plane defined by the first direction X and the third direction Z is suppressed by physical contact between these two (four in total) first contact portions 24 and the first bus bar 40 so that the posture of the contact 10 is maintained.

In particular, as shown in FIGS. 7A and 7B, since each conductive member 20 has the single contact-side engaging portion 26 and the contact-side engaging portion 26 of one of the conductive members 20 and the contact-side engaging portion 26 of the other conductive member 20 are arranged to be offset from each other in the third direction Z so that the contact-side engaging portions 26 are respectively engaged with the different bus bar-side engaging portions 41 and 42, the inclination (rotation) of the contact 10 relative to the first bus bar 40 in a plane defined by the second direction Y and the third direction Z is suppressed to thereby maintain the posture of the contact 10.

In particular, as shown in FIG. 8, since the contact 10 is formed with the inclination control portions 27, these inclination control portions 27 abut against the first bus bar 40 so that the inclination of the contact 10 relative to the first bus bar 40 (i.e. floating of the second contact portion 25 side of the contact 10 in the first direction X) is limited to a certain range.

Next, referring to FIGS. 9 and 10, the sequence of attaching the contact 10 to the second bus bar 50 and the operations of the respective portions during the attachment will be described.

Figure 9:
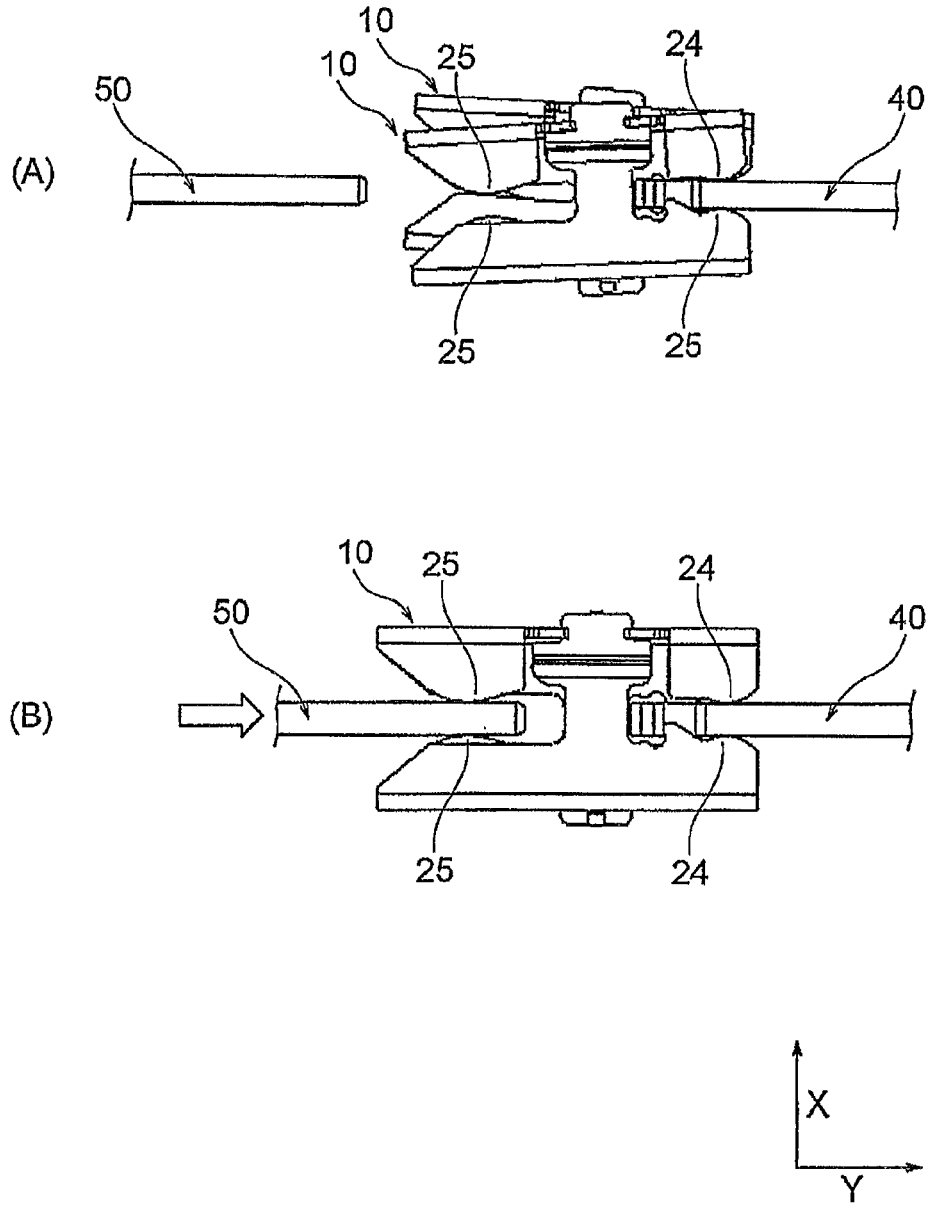
FIG. 9 is an explanatory diagram for explaining the sequence of attaching a second bus bar to the contact.
Figure 10:
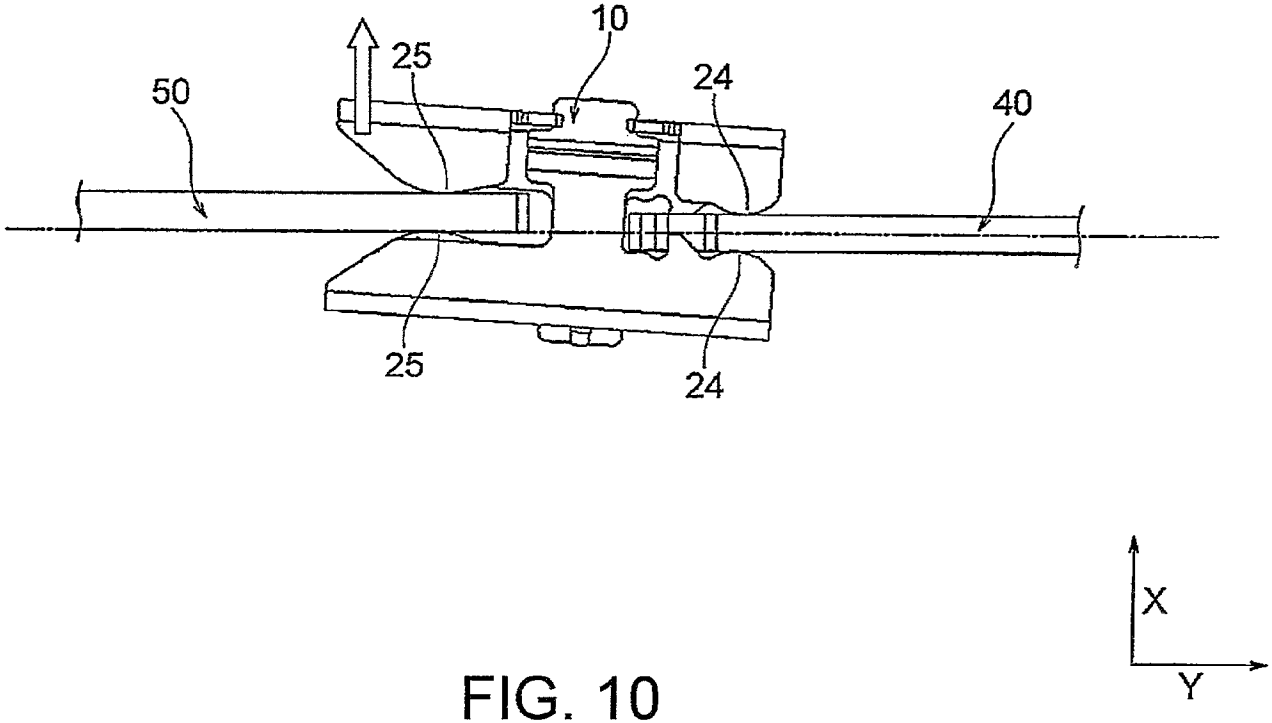
FIG. 10 is an explanatory diagram showing a state when the second bus bar is offset in position relative to the first bus bar.

When attaching the contact 10 to the second bus bar 50, the contact 10 is caused to approach the second bus bar 50 with the second contact portion 25 side at the head as shown at (A) in FIG. 9, thereby inserting the second bus bar 50 between the second contact portions 25. Thereupon, the pair of conductive members 20 are pushed by the second bus bar 50 to move a little in directions in which the second contact portions 25 move away from each other, so that the attachment of the contact 10 to the second bus bar 50 is completed as shown at (B) in FIG. 9. As shown in FIGS. 1 and 2, a guide portion 29A for guiding the second bus bar 50 is formed at a front end portion, on the second contact portion 25 side, of each conductive member 20.

In this manner, the first bus bar 40 inserted between the first contact portions 24 is held between the first contact portions 24 and the second bus bar 50 inserted between the second contact portions 25 is held between the second contact portions 25 so that the contact 10 establishes electrical connection between the first bus bar 40 and the second bus bar 50.

In the state where the attachment of the contact 10 to the first bus bar 40 is completed, the second contact portion 25 side of the contact 10 is capable of floating in the first direction X relative to the first bus bar 40 while maintaining the stable posture of the contact 10. Therefore, as shown in FIG. 10, even if there is a position offset in the first direction X between the second bus bar 50, which is inserted between the second contact portions 25, and the first bus bar 40, the second bus bar 50 can be smoothly inserted into the contact 10.

Figure 11:
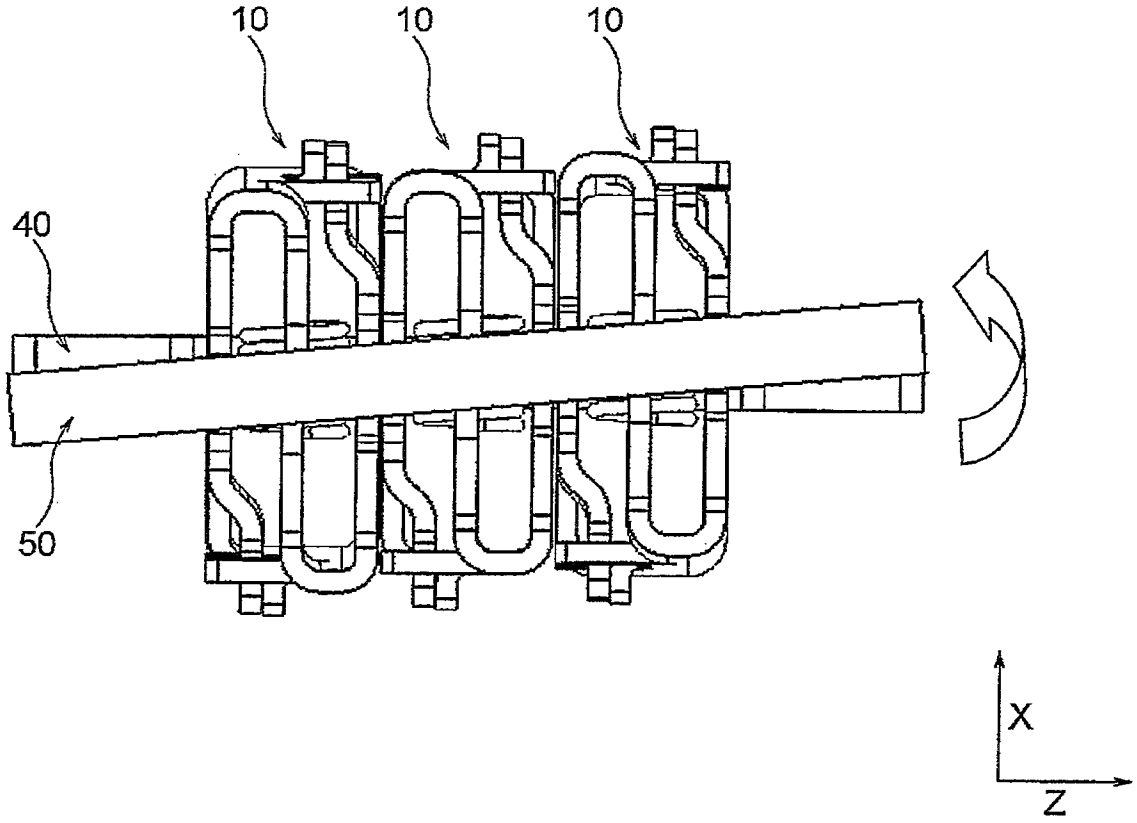
FIG. 11 is an explanatory diagram showing another state when the second bus bar is offset in position relative to the first bus bar.
Figure 12:
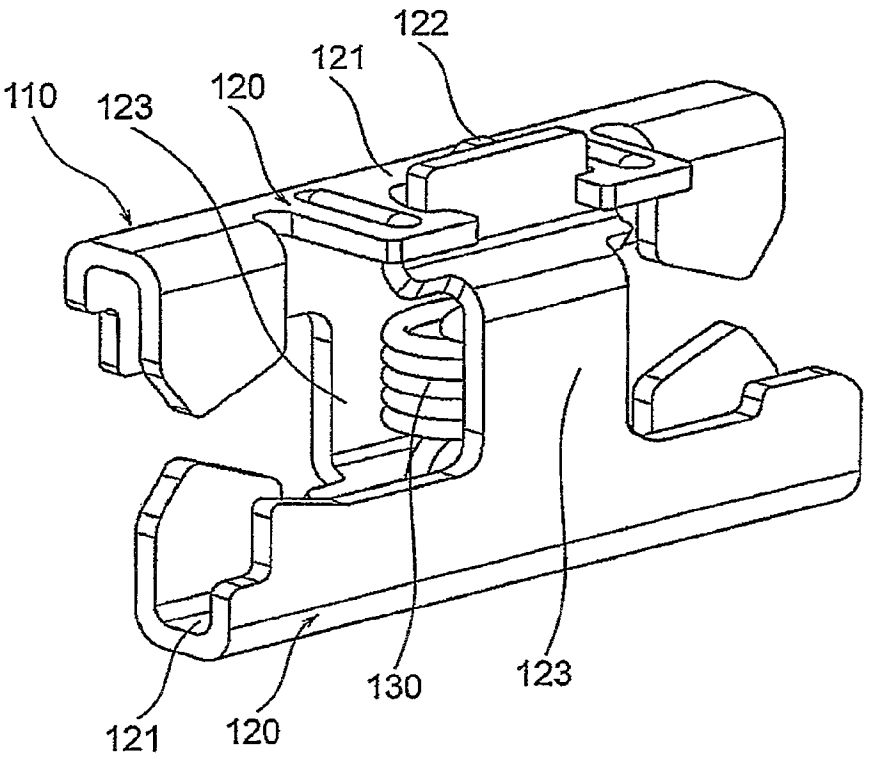
FIG. 12 is a perspective view showing a contact disclosed in Patent Document 1 (Japanese Patent (JP-B) No. 4938148).
Figure 13A:
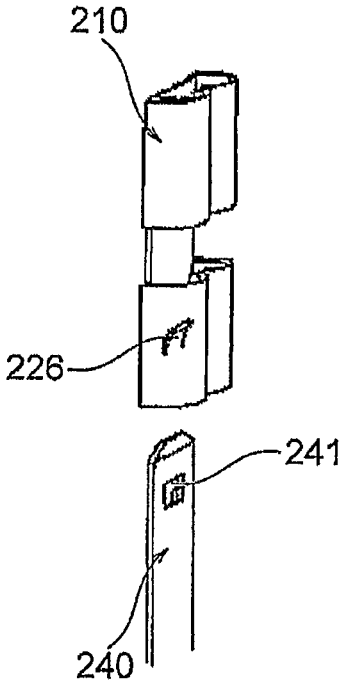
FIG. 13A is a perspective view showing a locking structure disclosed in Patent Document 2 (JP-A-H9-102345).
Figure 13B:
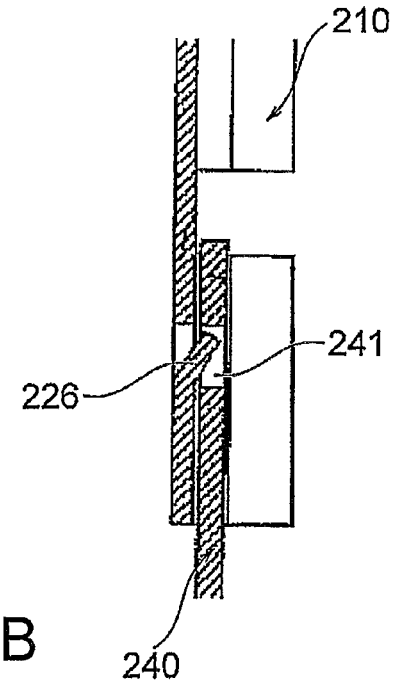
FIG. 13B is a cross-sectional view showing the locking structure of FIG. 13A.

As shown in FIG. 11, even if the second bus bar 50 is inclined in a plane defined by the first direction X and the third direction Z, since the second contact portion 25 sides of the contacts 10 independently float in the first direction X according to the inclination of the second bus bar 50, the second bus bar 50 can be smoothly inserted into the contacts 10.

Each conductive member 20 is formed with the single second contact portion 25 as different from the first contact portions 24. By this, when inserting the second bus bar 50 into the contact 10, it is possible to suppress interference of the second bus bar 50 with the second contact portions 25 and thus to smoothly insert the second bus bar 50 between the second contact portions 25.

Since the distance between the second contact portions 25 facing each other in the first direction X is set smaller than the thickness of the second bus bar 50, when the second bus bar 50 is inserted into the contact 10, the pair of conductive members 20 are pushed by the second bus bar 50 to shorten the distance between the first contact portions 24 facing each other in the first direction X so that the first bus bar 40 is held between the first contact portions 24, thereby establishing electrical contact between the contact 10 and the first and second bus bars 40 and 50.

This contact 10 is configured such that, rather than imparting elasticity to the contact-side engaging portions 26 themselves, the elastic force of the biasing member 30 causing the pair of conductive members 20 to approach each other is used to engage the inelastic contact-side engaging portions 26, each integrally formed in the conductive member 20, with the first bus bar 40. Therefore, the strength of the contact-side engaging portions 26 can be sufficiently ensured and, thus, even if an external force is applied to the first bus bar 40 in a pull-out direction, it is possible to surely prevent coming-off of the first bus bar 40 and further to prevent damage to the contact-side engaging portions 26.

When replacing or repairing the first bus bar 40 or the contact 10, it is possible to release the engagement between the contact-side engaging portions 26 and the first bus bar 40 by operating the conductive members 20 themselves rather than partially operating the contact-side engaging portions 26. Therefore, the first bus bar 40 can be easily detached from the contact 10 without damaging any of the portions.

It is configured such that the elastic force of the biasing member 30 is used to engage the contact-side engaging portions 26 with the first bus bar 40. Therefore, it is not necessary to separately provide a biasing means (biasing member) and thus it is possible to avoid an increase in the number of components.

In the above-mentioned embodiment, the description has been given assuming that the contact-side engaging portion 26 is in the form of a projection while the bus bar-side engaging portion 41, 42 is in the form of a hole or a cutout. However, a specific configuration of a contact-side engaging portion and a bus bar-side engaging portion may be any as long as they engage with each other using the elastic force of the biasing member 30. For example, the contact-side engaging portion may be in the form of a hole, a cutout, or a recess and the bus bar-side engaging portion may be in the form of a projection, or the contact-side engaging portion and the bus bar-side engaging portion may each be in the form of a projection or a stepped portion.

In the above-mentioned embodiment, the description has been given assuming that the contact-side engaging portion 26 is formed only on the first contact portion 24 side. However, the contact-side engaging portion 26 may be formed also on the second contact portion 25 side.

Further, in the above-mentioned embodiment, the contact-side engaging portion 26 is formed in the first plate portion 28A. However, the contact-side engaging portion 26 may be formed in each of the first plate portion 28A and the second plate portion 28B. Likewise, the inclination control portion 27 may also be formed in each of the first plate portion 28A and the second plate portion 28B.

In the above-mentioned embodiment, the description has been given assuming that the contact 10 has the first contact portions 24 for contact with the connection object 40 on one side and the second contact portions 25 for contact with the connection object 50 on the other side. However, if only a single connection object is fitted into the contact 10 from the outside, the contact 10 may be formed with contact portions only on one side.

In the above-mentioned embodiment, each conductive member 20 has the single second contact portion 25. However, like the first contact portions 24, the second contact portion 25 may be formed also on the first plate portion 28A side, thereby forming the second contact portions 25 in both plate portions.

In the above-mentioned embodiment, the description has been given assuming that the contact 10 is a contact for power supply. However, it may be used as a signal contact.

In the above-mentioned embodiment, the contact 10 is used without providing a housing that holds the contact 10. However, the housing may be provided so that use may be made of a connector having the contact 10 and the housing.

In the above-mentioned embodiment, the description has been given assuming that the biasing member 30 is in the form of a coil spring. However, a specific configuration of the biasing member 30 is not limited thereto and, for example, it may be formed by an elastic member such as a rubber.

In the above-mentioned embodiment, the description has been given assuming that the second direction Y is perpendicular to the first direction X. However, it may be configured such that the second direction Y is not perpendicular to the first direction X.

This invention is not limited to the above-mentioned embodiment and part or the whole of the above-mentioned embodiment can also be described as the following supplementary notes which, however, do not specify the scope of this invention.

(Supplementary Note 1)

A contact comprising a pair of conductive members and a biasing member attached between the pair of conductive members and biasing the pair of conductive members toward each other, the contact adapted to be connected to a connection object, inserted between the pair of conductive members, by holding the connection object between the pair of conductive members, wherein the pair of conductive members each have a base portion and an attaching portion formed at the base portion and attached with the biasing member, wherein the base portion of one of the conductive members and the base portion of the other of the conductive members are arranged to be spaced apart from each other, wherein at least one of the pair of conductive members has a support portion extending from the base portion side toward the other of the conductive members to contact and support the other of the conductive members, and wherein at least one of the pair of conductive members integrally has, at a position facing the side of the other of the conductive members, an inelastic contact-side engaging portion for engagement with a connection object-side engaging portion formed in the connection object.

(Supplementary Note 2)

The contact according to supplementary note 1, wherein the pair of conductive members each have a first contact portion for contact with the connection object and a second contact portion for contact with another connection object, the second contact portion formed on a side opposite to the first contact portion with respect to the attaching portion interposed therebetween, and wherein the contact-side engaging portion is formed on the first contact portion side with respect to the attaching portion.

(Supplementary Note 3)

The contact according to supplementary note 2, wherein at least one of the pair of conductive members has a plate portion extending from the base portion toward the other of the conductive members, and wherein the first contact portion and the contact-side engaging portion are formed in the same plate portion.

(Supplementary Note 4)

The contact according to supplementary note 2 or 3, wherein at least one of the pair of conductive members has an inclination control portion adapted to limit relative inclination between the connection object and the contact, and wherein the inclination control portion is formed on the first contact portion side with respect to the attaching portion at a position facing the side of the other of the conductive members.

(Supplementary Note 5)

The contact according to any one of supplementary notes 2 to 4, wherein the pair of conductive members each have a plurality of first contact portions, and wherein the plurality of first contact portions formed in each of the conductive members are arranged to be spaced apart from each other in a third direction that is perpendicular to a first direction as a biasing direction of the biasing member and to a second direction in which the connection object is inserted into the contact.

(Supplementary Note 6)

The contact according to any one of supplementary notes 2 to 5, wherein the pair of conductive members each have the contact-side engaging portion, and wherein the contact-side engaging portion of one of the conductive members and the contact-side engaging portion of the other of the conductive members are arranged at positions that are offset from each other in a third direction that is perpendicular to a first direction as a biasing direction of the biasing member and to a second direction in which the connection object is inserted into the contact.

(Supplementary Note 7)

The contact according to any one of supplementary notes 2 to 6, wherein a distance between the first contact portions facing each other in a first direction as a biasing direction of the biasing member is set greater than a thickness of the connection object in a state where neither of the connection object and the another connection object is inserted into the contact, and wherein a distance between the second contact portions facing each other in the first direction is set smaller than a thickness of the another connection object in the state where neither of the connection object and the another connection object is inserted into the contact.

(Supplementary Note 8)

The contact according to any one of supplementary notes 1 to 7, wherein the pair of conductive members has the same shape.

(Supplementary Note 9)

A connector comprising the contact according to any one of supplementary notes 1 to 8.

(Supplementary Note 10)

A connecting device comprising the contact according to any one of supplementary notes 1 to 8 and the connection object having the connection object-side engaging portion.

While this invention has been described with reference to the embodiment, the invention is not limited thereto. Various changes that can be understood by those skilled in the art can be made to the structures and details of this invention within the scope of this invention.

This application claims priority based on Japanese Patent Application No. 2012-157719, filed on Jul. 13, 2012, the disclosure of which is incorporated herein in its entirety.

DESCRIPTION OF SYMBOLS

10 contact
20 conductive member
21 base portion
22 attaching portion
23 support portion
24 first contact portion
25 second contact portion
26 contact-side engaging portion
27 inclination control portion
28A first plate portion (plate portion)
28B second plate portion
29A, 29B guide portion
30 biasing member
40 first bus bar (connection object)
41 bus bar-side engaging portion (connection object-side engaging portion)
42 bus bar-side engaging portion (connection object-side engaging portion)
50 second bus bar (another connection object)
X first direction
Y second direction
Z third direction

The invention claimed is:

1. A contact comprising:

a pair of conductive members; and a biasing member attached between the pair of conductive members and biasing the pair of conductive members toward each other, the contact adapted to be connected to a connection object, inserted between the pair of conductive members, by holding the connection object between the pair of conductive members, wherein the pair of conductive members each have a base portion and an attaching portion formed at the base portion and attached with the biasing member, wherein the base portion of one of the conductive members and the base portion of the other of the conductive members are arranged to be spaced apart from each other, wherein at least one of the pair of conductive members has a support portion extending from the base portion side toward the other of the conductive members to contact and support the other of the conductive members, and wherein at least one of the pair of conductive members integrally has, at a position facing the side of the other of the conductive members, an inelastic contact-side engaging portion for secure engagement with an aperture connection object-side engaging portion formed in the connection object.

2. The contact according to claim 1, wherein the pair of conductive members each have a first contact portion for contact with the connection object and a second contact portion for contact with another connection object, the second contact portion formed on a side opposite to the first contact portion with respect to the attaching portion interposed therebetween, and wherein the contact-side engaging portion is formed on the first contact portion side with respect to the attaching portion.

3. The contact according to claim 2, wherein at least one of the pair of conductive members has a plate portion extending from the base portion toward the other of the conductive members, and wherein the first contact portion and the contact-side engaging portion are formed in the same plate portion.

4. The contact according to claim 2, wherein at least one of the pair of conductive members has an inclination control portion adapted to limit relative inclination between the connection object and the contact, and wherein the inclination control portion is formed on the first contact portion side with respect to the attaching portion at a position facing the side of the other of the conductive members.

5. The contact according to claim 2, wherein the pair of conductive members each have a plurality of first contact portions, and wherein the plurality of first contact portions formed in each of the conductive members are arranged to be spaced apart from each other in a third direction that is perpendicular to a first direction as a biasing direction of the biasing member and to a second direction in which the connection object is inserted into the contact.

6. The contact according to claim 2, wherein the pair of conductive members each have the contact-side engaging portion, and wherein the contact-side engaging portion of one of the conductive members and the contact-side engaging portion of the other of the conductive members are arranged at positions that are offset from each other in a third direction that is perpendicular to a first direction as a biasing direction of the biasing member and to a second direction in which the connection object is inserted into the contact.

7. The contact according to claim 2, wherein a distance between the first contact portions facing each other in a first direction as a biasing direction of the biasing member is set greater than a thickness of the connection object in a state where neither of the connection object and the another connection object is inserted into the contact, and wherein a distance between the second contact portions facing each other in the first direction is set smaller than a thickness of the another connection object in the state where neither of the connection object and the another connection object is inserted into the contact.

8. The contact according to claim 1, wherein the pair of conductive members has the same shape.

9. A connector comprising the contact according to claim 1.

10. A connecting device comprising:

the contact according to claim 1; and a connection object inserted between the pair of conductive members and having a connection object-side engaging portion.

* * * * *